United States Patent [19]

Fujiura et al.

[11] 4,084,531

[45] Apr. 18, 1978

[54] FUEL TANK BREATHING MEANS FOR SMALL SIZE BOATS

[75] Inventors: Takashi Fujiura, Hyogo; Kunio Tsutsui; Hiroshi Nishida, both of Akashi, all of Japan

[73] Assignee: Kawasaki Jukogyo Kabushiki Kaisha, Kobe, Japan

[21] Appl. No.: 733,312

[22] Filed: Oct. 18, 1976

Related U.S. Application Data

[63] Continuation of Ser. No. 553,011, Feb. 25, 1975, abandoned.

[30] Foreign Application Priority Data

Feb. 26, 1974 Japan ..... 49-23553

[51] Int. Cl.[2] ..... B63H 2/00

[52] U.S. Cl. ..... 114/211; 115/70; 115/76

[58] Field of Search ..... 115/0.5 R, 0.5 E, 70, 115/17, 73, 76; 114/211, 212; 220/86 R, 85 VS, 85 VR

[56] References Cited

U.S. PATENT DOCUMENTS

| | | | |
|---|---|---|---|
| 3,115,114 | 12/1963 | Rapplean et al. | 115/0.5 |
| 3,369,518 | 2/1968 | Jacobson | 115/70 |
| 3,551,916 | 1/1971 | Reid | 114/211 X |

*Primary Examiner*—Trygve M. Blix
*Assistant Examiner*—Sherman D. Basinger
*Attorney, Agent, or Firm*—Stevens, Davis, Miller & Mosher

[57] ABSTRACT

Fuel tank breathing device for a small boat including a body and a handle column mounted on the body, a breathing conduit extending between a fuel tank in the body and a chamber defined in the column, the chamber in the column being provided with a ventilating and drain hole at its lower portion.

5 Claims, 1 Drawing Figure

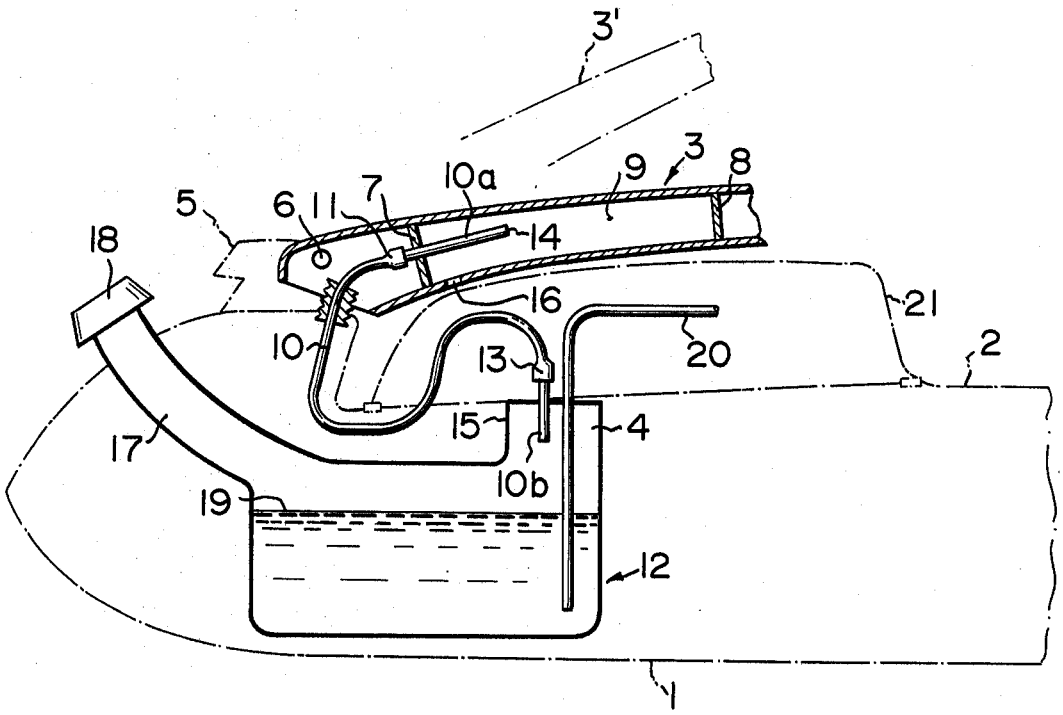
3'
3
8
9
10a
7
6
11
5
14
18
16
21
10
13
20
2
15
4
17
10b
19
12
1

FUEL TANK BREATHING MEANS FOR SMALL SIZE BOATS

This is a Continuation of application Ser. No. 553,011 filed Feb. 25, 1975 and now abandoned.

The present invention relates to fuel tank breathing means and more particularly the present invention pertains to breathing means for fuel tanks equipped in small sized boats.

In small sized boats, particularly those that have internal combustion engines and fuel tanks mounted in substantially closed chambers, it is required to have an end of fuel tank breathing pipe line opened outside the body of the boat. Otherwise, the closed chamber may be filled with vaporized fuel causing danger of explosion. However, in an arrangement in which the fuel tank breathing line is opened outside the body of the boat, another problem is encountered in that the outside opening of the breathing line may go under water during operation of the boat or when the boat is inadvertently turned over, so that water may flow into the fuel tank.

In order to overcome the problem, it has already been proposed to provide a cup-shaped water trap in the fuel tank breathing line so that water flown into the line is captured by the water trap and prevented from flowing into the fuel tank. In this arrangement, however, it is required that an operator takes water out of the trap whenever a certain amount of water is entrapped therein. Thus, a troublesome work is required for the operator. Further, the cup-shaped water trap must be mounted in the body of the boat and must be of limited volume. The present invention has therfore an object to eliminate the aforementioned problems in a boat having fuel tank breathing line opening to the outside of the body of the boat.

Another object of the present invention is to provide fuel tank breathing means for small sized boats, which can effectively prevent water from flowing into the fuel tank during operation of the boats.

According to the present invention, the above and other objects can be achieved by fuel tank breathing means for a boat having a body equipped with an internal combustion engine and a fuel tank, said breathing means comprising breathing conduit means having one end communicating with the fuel tank at its upper portion and the other end opening to a chamber defined outside the body of the boat, said chamber having ventilating and drain aperture means formed at lower portion thereof.

The above and other objects and features of the present invention will become apparent from the following descriptions of a preferred embodiment taking reference to the accompanying drawing which is a fragmentary sectional view of the boat embodying the feature of the present invention.

Referring to the drawing, there is shown a boat that is designed in accordance with the United States design patent Des. 233,140. The boat includes a body 1 having an upper deck 2 and a handle column 3 pivotally mounted at its front end portion on a bracket 5 of the body 1 by means of a transversely extending shaft 6. The boat may be equipped with water jet type thrust means which is driven by an internal combustion engine (not shown). In operation of the boat, an operator stands on the deck 2 and sets up the column 3 to the position shown by a broken line 3' so that the operator can grasp and actuate the handle grips (not shown) provided at the rear end of the column 3.

In the body 1, there is provided a fuel tank 12 having a fuel inlet conduit 17 provided with a filler cap 18. The fuel tank 12 is further formed with an upwardly extending portion 15 so as to provide a space 4 above the level 19 of fuel in the tank 12. A fuel supply conduit 20 extends from the fuel tank 12 through a fuel pump (not shown) to the engine as is well known in the art.

The column 3 is of a hollow structure having a substantially rectangular cross-section. In the column 3, there is disposed a pair of spaced partition walls 7 and 8 so that a chamber 9 of substantial volume is defined therein. Thus, the column 3 constitutes a floatable body of appreciable volume. A fuel tank breathing hose 10 is disposed to extend between the column 3 and the fuel tank 12. The hose 10 has one end 11 connected to an end pipe **10*a* which extends into and opens at 14 to the chamber 9. The other end 13 of the hose 10 is connected to an end pipe 10*b* which opens to the space 4 in the fuel tank 12. The column 3 is formed with a ventilating and drain hole 16 at the bottom part of the chamber 9. In the drawing, the reference numeral 21** designates an engine cover.

In operation, fuel in the tank 12 is continuously supplied through the pipe 20 to the engine so that the volume of the space 4 is increased. As the volume of the space 4 increases, the outside air is introduced into the space 4 through the hole 16, the chamber 9 and the breathing hose 10. When the engine is out of operation, liquid fuel may be vaporized into the space 4 and, due to possible thermal expansion, the fuel vapour containing air in the space 4 is exhausted through the hose 10, the chamber 9 and the hole 16. Through the breathing function, the interior of the fuel tank can be maintained at an atmospheric pressure.

During operation of the boat, water splash may enter through the hole 16 into the chamber 9. However, since the pipe **10*a* extends deeply into the chamber 9, there is least possibility that the water is splashed into the pipe 10*a*. Further, since the hole 16 is disposed at a lower portion of the chamber 9, water entered into the chamber 9 is drained through the hole 16**.

The boat of the type illustrated is often operated under extremely acrobatic control so that there is often risk of being turned over. When the boat is turned over, the buoyancy of the column 3 effectively helps the boat to restore its correct position. Since the boat can thus be returned to its correct position very rapidly after turnover, there is not sufficient time in which water entering through the hole 16 into the chamber 9 reach the opening 14 of the pipe **10*a*. After the boat has restored its position, water in the chamber 9 is drained through the hole 16**.

The invention has been shown and described with reference to a specific embodiment, however, it should be noted that the invention is in no way limited to the details of the illustrated structures but changes and modifications may be made without departing from the scope of the appended claims. For example, the invention is not limited to the application of the specific type of boats as illustrated in the drawing but it can be applied to any other types of boats. Further, it is of course possible to provide a plurality of ventilating and drain holes.

We claim:

1. Fuel tank breathing means for a boat having a body equipped with an internal combustion engine, a fuel tank, and a hollow handle column pivotally mounted at one end thereof on said body of the boat, said breathing means comprising breathing conduit means having one end communicating with the fuel tank at its upper portion and the other end projecting into and opening to a chamber defined in the column outside the body of the boat, said chamber having ventilating and drain aperture means formed at a lower portion thereof.

2. Fuel tank breathing means in accordance with claim 1 in which said breathing conduit means deeply extends into the chamber defined in the column.

3. Fuel tank breathing means in accordance with claim 1 in which said breathing conduit means comprises a hose connected at one end with a pipe which extends into the chamber defined in the column.

4. Fuel tank breathing means for a boat having a body equipped with an internal combustion engine, a fuel tank, an elongated hollow handle column mounted on said body, at least one wall in said column extending transversely thereof and defining with said column a chamber, a ventilating and drain aperture in the lower portion of the chamber, said breathing means comprises an elongated conduit, one end of said conduit being fluidly communicated with an upper portion of the fuel tank, and the other end of said conduit extending longitudinally within said column from the lower end thereof and extending through said wall and projecting into said chamber.

5. Fuel tank breathing means in accordance with claim 4 in which said column is pivotally mounted at one end thereof on said body of the boat.

* * * * *